US005221602A

United States Patent [19]

Maskasky

[11] Patent Number: 5,221,602

[45] Date of Patent: Jun. 22, 1993

[54] PROCESS FOR THE PREPARATION OF A GRAIN STABILIZED HIGH CHLORIDE TABULAR GRAIN PHOTOGRAPHIC EMULSION (I)

[75] Inventor: Joe E. Maskasky, Rochester, N.Y.

[73] Assignee: Eastman Kodak Company, Rochester, N.Y.

[21] Appl. No.: 820,182

[22] Filed: Jan. 13, 1992

Related U.S. Application Data

[63] Continuation-in-part of Ser. No. 763,030, Sep. 20, 1991.

[51] Int. Cl.[5] ..... G03C 1/015

[52] U.S. Cl. ..... 430/569; 430/567; 430/570; 430/614

[58] Field of Search ..... 430/567, 569, 570, 614

[56] References Cited

U.S. PATENT DOCUMENTS

| | | | |
|---|---|---|---|
| 4,400,463 | 8/1983 | Maskasky | 430/434 |
| 4,448,878 | 5/1984 | Yamamuro et al. | 430/614 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |

FOREIGN PATENT DOCUMENTS 03-116133 5/1991 Japan .

OTHER PUBLICATIONS

Research Disclosure, vol. 308, Dec. 1989, Item 308119.

*Primary Examiner*—Charles L. Bowers, Jr.
*Assistant Examiner*—Janet C. Baxter
*Attorney, Agent, or Firm*—Carl O. Thomas

[57] ABSTRACT

A process is disclosed of preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine absorbed to and morphologically stabilizing the tabular grains. Protonation releases 2-hydroaminoazine from the tabular grain surfaces into the dispersing medium. Released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the dispersing medium.

11 Claims, 8 Drawing Sheets

1 μm

1 μm

1 μm

1 μm

1 μm

1 μm

PROCESS FOR THE PREPARATION OF A GRAIN STABILIZED HIGH CHLORIDE TABULAR GRAIN PHOTOGRAPHIC EMULSION (I)

This is a continuation-in-part of U.S. Ser. No. 763,030, filed Sep. 20, 1991, now pending.

FIELD OF THE INVENTION

The invention is directed to a process of preparing for photographic use high chloride tabular grain emulsions.

DEFINITION OF TERMS

The term "high chloride" refers to silver halide grains or emulsions in which chloride accounts for at least 50 mole percent of total halide, based on silver.

The term "2-hydroaminoazine" refers to azines having a primary or secondary amino substituent that is bonded to the azine ring at a location next adjacent a ring nitrogen atom.

The term "hydroamino" is employed to designate amino groups containing at least one hydrogen substituent of the nitrogen atom—i e., a primary or secondary amino substituent.

The term "azine" is employed to embrace six membered aromatic heterocylic rings containing carbon atoms and at least one nitrogen atom.

The term "morphological stabilization" refers to stabilizing the geometrical shape of a grain.

The term "stabilizer" is employed in its art recognized usage to designate photographic addenda that retard variances in emulsion sensitometric properties.

The term "tabular grain" is employed to designate grains having two parallel major faces lying in {111} crystallographic planes.

The terms "monolayer coverage" and "monomolecular layer" are employed in their art recognized usage to designate the calculated concentration of an adsorbed species that, if uniformly distributed on emulsion grain surfaces, would provide a layer of one molecule thickness.

The term "photographically useful compound" refers to compounds (i.e., addenda) that function during the storage, exposure and/or processing of photographic elements to enhance their image forming properties.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystographic planes. To produce successfully a high chloride tabular grain emulsion by twinning, conditions must be found that favor both the formation of twin planes and {111} crystal faces. Further, after the emulsion has been formed, tabular grain morphological stabilization is required to avoid reversion of the grains to their favored more stable form exhibiting {100} crystal faces. When high chloride tabular grains having {111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 (hereinafter designated Maskasky I) was the first to prepare in the presence of a 2-hydroaminoazine a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. As grain growth modifiers, Tufano et al U.S. Pat. No. 4,804,621 employed 4,6-di(hydroamino)-pyrimidines lacking a 5-position amino substituent (a 2-hydroaminoazine species); Japanese patent application 03/116,133, published May 17, 1991, employed adenine (a 2-hydroaminoazine species) in the pH range of from 4.5 to 8.5; Takada et al U.S. Pat. No. 4,783,398 employed heterocycles containing a divalent sulfur ring atom; Nishikawa et al U.S. Pat. No. 4,952,491 employed spectral sensitizing dyes and acyclic compounds; and Ishiguro et al U.S. Pat. No. 4,983,508 employed organic bis-quaternary amine salts.

In the foregoing patents there is little or no mention of stabilizing the tabular grain shape in the high chloride emulsions, since the continued presence of conditions favorable for stabilizing the {111} major faces of the tabular grains, usually the presence of a 2-hydroaminoazine, is assumed. Houle et al U.S. Pat. No. 5,035,992 specifically addresses the problem of stabilizing high chloride tabular grain emulsions prepared in the presence of a 2-hydroaminoazine (specifically 4,6-di(hydroamino)-pyrimidines lacking a 5-position amino substituent). Houle et al accomplished stabilization during tabular grain precipitation by continuously increasing the ratio of bromide to chloride being precipitated until the tabular grains were provided with stabilizing silver bromide shells. The Houle et al process is, of course, incompatible with producing a pure chloride emulsion, since at least some silver bromide must be included, and the process also has the disadvantage that the pyrimidine is left on the grain surfaces. Additionally, as shown in the Examples below, the grains remain morphologically unstable when their pH is lowered to remove the pyrimidine.

The emulsion teachings noted above either explicitly or implicitly suggest utilization of the emulsions with conventional grain adsorbed and unadsorbed addenda. A relatively recent summary of conventional photographic emulsion addenda is contained in Research Disclosure Vol. 308, December 1989, Item 308119. Research Disclosure is published by Kenneth Mason Publications, Ltd., Emsworth, Hampshire P010 7DD, England. While a wide variety of emulsion addenda can be adsorbed to grain surfaces, spectral sensitizing dyes and desensitizers (Res. Dis. Section IV) and antifoggants and stabilizers (Res. Dis. Section VI) are examples of photographically useful addenda that are almost always adsorbed to grain surfaces.

RELATED PATENT APPLICATIONS

Maskasky U.S. Serial No. 762 971,filed Sep. 20, 1991, commonly assigned, now allowed, titled IMPROVED PROCESS FOR THE PREPARATION OF HIGH CHLORIDE TABULAR GRAIN EMULSIONS (II), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar and a 2-hydroaminoazine grain growth modifier of the formula:

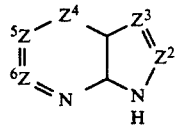

where $Z^2$ is $—C(R^2)=$ or $—N=$;

$Z^3$ is $—C(R^3)=$ or $—N=$;

$Z^4$ is $—C(R^4)=$ or $—N=$;

$Z^5$ is $—C(R^5)=$ or $—N=$;

$Z^6$ is $—C(R^6)=$ or $—N=$;

with the proviso that no more than one of $Z^4$, $Z^5$ and $Z^6$ is $—N=$;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 819,712, filed concurrently herewith (as a continuation-in-art of U.S. Ser. No. 763,382, filed Sep. 20, 1991, now abandoned) and commonly assigned, now allowed, IMPROVED PROCESS FOR THE PREPARATION OF HIGH CHLORIDE TABULAR GRAIN EMULSIONS (IV), (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents. This grain growth modifier is a 2-hydroaminozine species.

Maskasky U.S. Ser. No. 820,168, filed concurrently herewith (as a continuation-in-art of U.S. Ser. No. 763,382 filed Sep. 20, 1991, now abandoned) and commonly assigned, now allowed, titled IMPROVED PROCESS FOR THE PREPARATION OF HIGH CHLORIDE TABULAR GRAIN EMULSIONS (V), (hereinafter designated Maskasky V) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a 2-hydroaminoazine grain growth modifier of the formula:

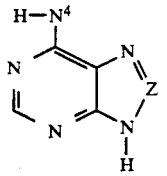

where $N^4$ is an amino moiety and

Z represents the atoms completing a 5 or 6 member ring.

Maskasky and Chang U.S. Ser. No. 763,013, filed Sep. 20, 1991, commonly assigned, now allowed, titled IMPROVED PROCESS FOR THE PREPARATION OF HIGH CHLORIDE TABULAR GRAIN EMULSIONS (III), (hereinafter designated Maskasky et al I) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

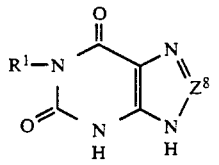

where $Z^8$ is —C($R^8$)= or —N=;

$R^8$ is H, $NH_2$ or $CH_3$; and $R^1$ is hydrogen or a hydrocarbon containing from 1 to 7 carbon atoms. The grain growth modifier is not a 2-hydroaminoazine.

Maskasky and Chang U.S. Ser. No. 820,181, filed concurrently herewith and commonly assigned and now allowed (hereinafter referred to as Maskasky et al II), titled PROCESS FOR THE PREPARATION OF A GRAIN STABILIZED HIGH CHLORIDE TABULAR GRAIN PHOTOGRAPHIC EMULSION (II), discloses a process of preparing an emulsion for photographic use comprising (a) forming an emulsion as taught by Maskasky et al I, above, (b) reducing the pH of the dispersing medium below 4.0 to inactivate the xanthinoid as a morphological stabilizer, and (c) replacing the inactivated xanthinoid on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

SUMMARY OF THE INVENTION

In one aspect this invention is directed to a process preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one 2-hydroaminoazine adsorbed to and morphologically stabilizing the tabular grains, and (2) adsorbing to surfaces of the tabular grains a photographically useful compound.

The process is characterized in that (a) 2hydroaminoazine adsorbed to the tabular grain surfaces is protonated and thereby released from the tabular grain surfaces into the dispersing medium, (b) the released 2-hydroaminoazine is replaced on the tabular grain surfaces by adsorption of the photographically useful compound, the photographically useful compound being selected from among those containing at least one divalent sulfur atom, thereby concurrently morphologically stabilizing the tabular grains and enhancing their photographic utility, and (c) released 2-hydroaminoazine is removed from the dispersing medium.

The present invention offers a combination of advantages. From a review of the various citations above it is apparent that the majority of emulsion preparations rely on one species or another of 2-hydroaminoazine, typically adenine or a 4,6-diaminopyrimidine lacking a 5-position amino substituent, as a grain growth modifier to produce high chloride tabular grains having {111} major grain faces. Despite the efficacy of these grain growth modifiers to produce and maintain the desired tabular grain morphologies, at a minimum they represent an additional emulsion ingredient, thereby adding to the complexity of photographic emulsions that often contain many ingredients and adding to the complexity of photographic elements that can contain many different layers, often including multiple emulsion layers of varying composition and photographic performance characteristics. To the extent that the grain growth modifiers remain adsorbed to the tabular grains they compete with other adsorbed photographic addenda for grain surface sites. To the extent that the grain growth modifiers equilibrate with the surrounding emulsion dispersing medium they can affect other photographic element layers and solutions used for processing.

In the practice of the present invention at least a portion of the adsorbed 2-hydroaminoazine grain growth modifier is released from the high chloride tabular grain surfaces and replaced by one or more photographically useful adsorbed photographic addenda capable of preventing the morphologically unstable tabular grains with {111} major faces from reverting to less photographically desirable morphological grain forms. It has been observed that this function can be performed by employing one or more photographically useful compounds selected to contain at least one divalent sulfur atom. Fortunately, a wide variety of photographically useful compounds are known containing at least one divalent sulfur atom. Thus, replacement of adsorbed 2-hydroaminoazine with a conventional compound of this type allows the complexity of the emulsion to be reduced and increases the grain surface area available to be occupied by compounds that both morphologically stabilize the tabular grains and perform photographically useful functions.

A further distinct advantage of the present invention is that released 2-hydroaminoazine grain growth modifier is removed from the emulsion. This can be used to minimize or eliminate entirely subsequent interaction of the grain growth modifier with other portions of the photographic element in which the emulsion is incorporated (e.g., other emulsion layers) as well as eliminating any possibility of accumulating the grain growth modifier in processing solutions (particularly acidic solutions). Still further, the released and removed 2-hydroaminoazine can be reclaimed, thereby minimizing waste and allowing reuse of the grain growth modifier in preparing subsequent emulsions.

DESCRIPTION OF PREFERRED EMBODIMENTS

Figure 1:
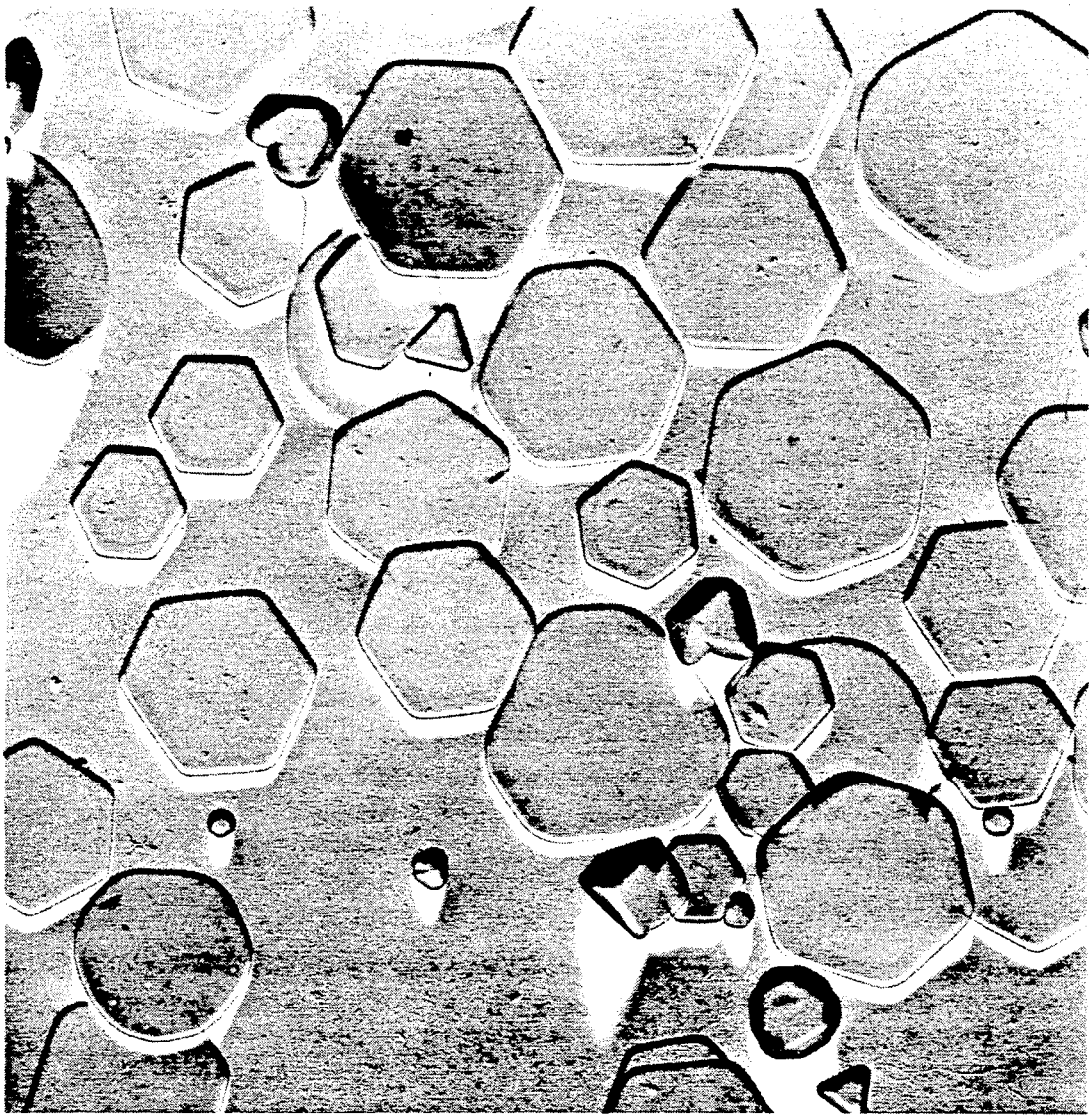
FIGS. 1 to 5 inclusive are carbon replica electron photomicrographs.

The present invention is directed to a process of improving for photographic use the properties of a high chloride tabular grain emulsion in which the tabular grains have major faces lying in {111} crystallographic planes and rely on a 2-hydroaminoazine adsorbed to surfaces of the tabular grains for morphological stabilization. Emulsions of this type are illustrated by Maskasky U.S. Pat. No. 4,713,323, King et al U.S. Pat. No. 4,942,120, Tufano et al U.S. Pat. No. 4,804,621, Japanese patent application 03/116,133, published May 17, 1991, and Houle et al U.S. Pat. No. 5,035,992, the disclosures of which are here incorporated by reference.

The emulsions contain in addition to the grains and adsorbed 2-hydroaminoazine a conventional dispersing medium for the grains. The dispersing medium is invariably an aqueous medium and in the overwhelming majority of applications contains a gelatino-peptizer. In the practice of the invention the pH of the dispersing medium is lowered until the 2-hydroaminoazine adsorbed to the tabular grain surfaces is protonated. This transforms the 2-hydroamino moiety into a cationic moiety having a diminished adsorption capability and also renders the protonated 2-hydroaminoazine soluble in the aqueous (and hence polar) dispersing medium.

To protect the tabular grains from morphological degradation to less tabular grain shapes the released 2-hydroaminoazine is replaced on the tabular grain surfaces with any one or combination of known photographically useful addenda known to adsorb to grain surfaces. By selecting photographically useful addenda for incorporation that contain at least one divalent sulfur atom the morphological stabilization function performed by the 2-hydroaminoazine prior to protonation and release is performed while the known photographic utility of the replacement adsorbed compound is also realized. In other words the replacement adsorbed compounds is now performing at least two distinct functions.

After the replacement compound has been adsorbed to the tabular grain surfaces, the released protonated 2-hydroaminoazine can be removed from the dispersing medium using any convenient conventional technique for removing emulsion solutes, such as coagulation washing, ultrafiltration and the like. Illustrative procedures of this type are summarized in Research Disclosure Item 308119, cited above, Section II, the disclosure of which is here incorporated by reference. The 2-hydroaminoazine removed from the emulsion can be reclaimed and reused, if desired. If discarded, the 2-hydroaminoazines can be selected for minimal cost and ecological impact. Adenine (Vitamin B4) is a specific example of a low cost, ecologically benign 2-hydroaminoazine.

Preferred high chloride tabular grain emulsions for use in the practice of the invention contain tabular grains accounting for at least 50 percent of total grain projected area that contain at least 50 mole percent chloride, based on total silver. The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on total silver while the iodide content is preferably less than 2 mole percent and optimally less than 1 mole percent. When more than one halide ion is present in the tabular grains, the halides can be uniformly or nonuniformly distributed. For example, the invention is applicable to emulsions of the type disclosed by Houle et al, cited and incorporated by reference above.

The photographic advantages of tabular grains are a function of their tabularity. Preferred emulsions in which the tabular grains exhibit a high mean tabularity—that is, they satisfy the mean tabularity relationship:

$$\frac{ECD}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, $ECD/t > 8$. When high aspect ratio tabular grains exhibit a thickness of 0.3 μm or less, the grains also exhibit high tabularity. When the thickness of the tabular grains is 0.2 μm or less, high tabularities can be realized at intermediate aspect ratios of 5 or more.

Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less. Tufano et al, cited and incorporated by reference above, discloses high chloride tabular grain emulsions satisfying the requirements of this invention having thicknesses ranging down to 0.062 μm (388 {111} crystal lattice planes). In U.S. Ser. No. 763,030, filed Sep. 20, 1991, cited above and here incorporated by reference, ultrathin tabular grain emulsions are disclosed in which high chloride tabular grains have mean thicknesses of less than 360 {111} lattice planes. Using a silver chloride {111} lattice spacing of 1.6Å as a reference, the following correlation of grain thicknesses in μm applies:

360 lattices planes $<0.06$ μm
300 lattices planes $<0.05$ μm
180 lattices planes $<0.03$ μm
120 lattices planes $<0.02$ μm Ultrathin high chloride tabular grain emulsions in which mean grain thicknesses range down to 120 lattice planes can be prepared.

It is specifically contemplated to apply the practice of the present invention to thin ($t<0.2$ μm) and ultrathin ($t<360$ {111} lattice planes), since the morphological instability of the tabular grains increases as their mean thickness decreases.

To maximize the advantages of having high chloride tabular grains present in the emulsions it is preferred that the high chloride tabular grains account for greater than 70 percent and, optimally, greater than 90 percent of total grain projected area. With care in preparation or when accompanied by conventional grain separation techniques the projected area accounted for by high chloride tabular grains can approximate 100 percent of total grain projected area for all practical purposes.

Grains other than the high chloride tabular grains when present in the emulsion are generally coprecipitated grains of the same halide composition. It is recognized that for a variety of applications the blending of emulsions is undertaken to achieve specific photographic objectives. When the photographically useful compound intended to replace the released protonated 2-hydroaminoazine can be usefully adsorbed to the grains of all component emulsions, the protonation and subsequent process steps can usefully occur after blending. It is therefore apparent that the grains of the emulsion other than the high chloride tabular grains can take any of a wide variety of forms in halide content, size and crystallographic shape. It is generally advantageous to release the 2-hydroaminoazine from the grain surfaces after precipitation and before washing, thereby avoiding a second washing step for removal of protonated 2-hydroaminoazine. When the photographically useful compound intended to replace the released protonated 2-hydroaminoazine is intended to be adsorbed only to the high chloride grain surfaces, the process of the present invention is, of course, practiced before blending.

The essential structural components of the 2-hydroaminoazine can be visualized from the following formula:

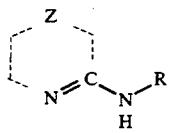

(I)

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

The structural features in formula I that morphologically stabilize the tabular grain {111} crystal faces are (1) the spatial relationship of the two nitrogen atoms shown, (2) the aromatic ring stabilization of the left nitrogen atom, and (3) the hydrogen attached to the right nitrogen atom. It is believed that the two nitrogen atoms interact with the {111} crystal face to facilitate adsorption. The atoms forming R and Z can, but need not, be chosen to actively influence adsorption and morphological stabilization. Various forms of Z and R are illustrated by various species of 2-hydroaminoazines described below.

In one illustrative form the 2hydroaminoazine can satisfy the formula:

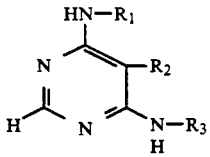

(II)

wherein $R_1$, $R_2$ and $R_3$, which may be the same or different, are H or alkyl of 1 to 5 carbon atoms; $R_2$ and $R_3$ when taken together can be $—CR_4=CR_5—$ or $—CR_4=N—$, wherein $R_4$ and $R_5$, which may be the same or different are H or alkyl of 1 to 5 carbon atoms, with the proviso that when $R_3$ taken together form the $—CR_4=N—$ linkage, $—CR_4=$must be joined to the ring at the $R_2$ bonding position.

In another illustrative form the 2-hydroaminoazine can satisfy the following formula:

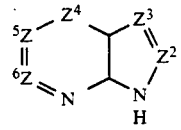

(III)

where $Z^2$ is $—C(R_2)=$ or $—N=$;
$Z^3$ is $—C(R_3)=$ or $—N=$;
$Z^4$ is $—C(R_4)=$ or $—N=$;
$Z^5$ is $—C(R_5)=$ or $—N=$;
$Z^6$ is $—C(R_6)=$ or $—N=$;
with the proviso that no more than one of $Z^4$, $Z^5$ and $Z^6$ is $—N=$;
$R^2$ is H, $NH_2$ or $CH_3$;
$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and
$R^6$ is H or $NH_2$.

In an additional illustrative form the 2-hydroaminoazine can take the form of a triamino-pyrimidine grain growth modifier containing mutually independent 4, 5 and 6 ring position amino substituents with the 4 and 6 ring position substituents being hydroamino substituents. The 2-hydroaminoazine in this form can satisfy the formula:

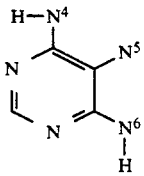

(IV)

where $N^4$, $N^5$ and $N^6$ are independent amino moieties.

In a specifically preferred form the 2-hydroaminoazines satisfying formula IV satisfy the following formula:

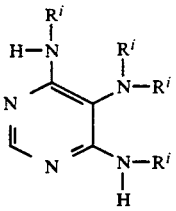

(V)

where $R^i$ is independently in each occurrence hydrogen or alkyl of from 1 to 7 carbon atoms.

In still another illustrative form the 2-hydroaminoazine can satisfy the formula:

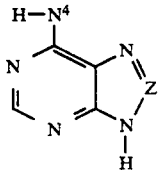

(VI)

where $N^4$ is an amino moiety and

Z represents the atoms completing a 5 or 6 member ring.

The high chloride tabular grain emulsions as initially prepared can contain any concentration of 2-hydroaminoazine capable of morphologically stabilizing the tabular grains. Adequate morphological stabilization of the tabular grains is realized when the 2-hydroaminoazine is present in the emulsion in a concentration of at least 25 percent of monolayer coverage. Maximum protection of the tabular grains is theoretically realized when sufficient 2-hydroaminoazine is present to provide complete (100 percent) monolayer coverage, although in practice maximum attainable morphological stabilization is observed at concentrations of 75 percent of monolayer coverage or less. Inclusions of excess 2-hydroaminoazine beyond that which can be adsorbed to grain surfaces can be accommodated, the excess unadsorbed 2-hydroaminoazine is readily removed by washing.

Protonation of the 2-hydroaminoazine adsorbed to the high chloride tabular grain surfaces to effect release into the dispersing medium can be achieved merely by lowering the pH of emulsion. pH is preferably lowered using the same mineral acids (e.g., sulfuric acid or nitric acid) conventionally used to adjust pH during emulsion precipitation. While each 2-hydroaminoazine is protonated at a slightly different pH, protonation of preferred compounds can be effected within the pH range of from 5.0 to 1.0, most preferably from 4.0 to 1.5. Protonation in these ranges is highly advantageous, since it allows the common pH ranges of emulsion precipitation to be employed and allows protonation to be achieved without subjecting the emulsions to extremely acidic conditions that could degrade other components.

In choosing photographically useful compounds containing at least one divalent sulfur atom to replace the protonated and released 2-hydroaminoazine as a morphological stabilizer on the tabular grain surfaces a wide variety of conventional photographically useful emulsion addenda are available to choose among. Spectral sensitizing dyes, desensitizers, hole trapping dyes, antifoggants, stabilizers and development modifiers are illustrations of different classes of photographically useful compounds that can be selected to contain one or more divalent sulfur atom containing moieties. A wide variety of photographically useful compounds containing one or more divalent sulfur atoms is disclosed in Research Disclosure, Item 308119, cited above and here incorporated by reference.

The following are illustrative of varied divalent sulfur atom moieties commonly found in photographically useful compounds:

$$-S-H \qquad \text{M-1}$$

mercapto $$-S-R^a \qquad \text{M-2}$$

where $R^a$ is any convenient hydrocarbon or substituted hydrocarbon—e.g., when $R^a$ an alkyl group the resulting moiety is an alkylthia moiety (methylthia, ethylthia, propylthia, etc.) and when $R^a$ is an aromatic group the resulting moiety is an arylthia moiety (phenylthia, naphthylthia, etc.) or $R^a$ can be a heterocyclic nucleus, such as any of the various heterocyclic nuclei found in cyanine dyes.

$$-S-S-R^a \qquad \text{M-3}$$

where $R^a$ is as described above

| | |
|---|---|
| M-4 | 1,4-thiazine |
| M-5 | thiazoline |
| M-6 | thiazole |
| M-7 | thiophene |
| M-8 | 3-thia-1,4-diazole |
| M-9 | benzothiazole |
| M-10 | naphtho[2,1-d]thiazole |
| M-11 | naphtho[1,2-d]thiazole |
| M-12 | naphtho[2,3-b]thiazole |
| M-13 | thiazolo[4,5-b]quinoline |
| M-14 | 4,5-dihydrobenzothiazole |
| M-15 | 4,5,6,7-tetrahydrobenzothiazole |
| M-16 | 4,5-dihydronaptho[1,2-d]thiazole |
| M-17 | phenanthrothiazole |
| M-18 | acenaphthothiazole |
| M-19 | isorhodanine |
| M-20 | rhodanine |
| M-21 | thiazolidin-2,4-dione |
| M-22 | thiazolidin-2,4-dithione |
| M-23 | 2-dicyanomethylenethiazolidin-4-one |
| M-24 | 2-diphenylamino-1,3-thiazolin-4-one |
| M-25 | benzothiophen-3-one |

The moieties M-1 to M-8 as well as some of the subsequent moieties, such as M-9 and M-20, are commonly encountered in various photographically useful compounds such as antifoggants, stabilizers and development modifiers. The moieties M-5 to M-18 are common heterocyclic nuclei in polymethine dyes, particularly cyanine and merocyanine sensitizing dyes. The moieties M-19 to M-25 are common acidic nuclei in merocyanine dyes. The heterocyclic moieties M-4 to M-25 are named as rings, since the site of ring attachment can be at any ring carbon atom and ring, substituents, if any, can take any convenient conventional form, such as any of the various forms described above in connection with $R^a$.

The photographically useful compound containing one or more divalent sulfur atom containing moieties is introduced into the dispersing medium in an amount sufficient to provide at least 20 percent of monomolecular coverage on the grain surfaces. It is preferred to introduce the photographically useful compound in a concentration sufficient to provide from 50 to 100 percent of monomolecular coverage. Introducing greater amounts of the photographically useful compound than can be adsorbed on grain surfaces is inefficient, since unadsorbed compound is susceptible to removal from the emulsion during subsequent washing If higher concentrations of the divalent sulfur atom containing compound are desired to satisfy its photographic utility unrelated to morphological grain stabilization, further addition of the compound can be deferred until after the washing step.

It is generally preferred to dissolve in the dispersing medium of the emulsion the photographically useful compound intended to replace the 2-hydroaminoazine on the grain surfaces before protonation of the latter is undertaken. In this arrangement the compound adsorbs to the grain surfaces as the 2-hydroaminoazine vacates grain surface sites. This entirely precludes any risk of morphological degradation of the tabular grains by reversion to {100} crystal faces.

As an alternative it is specifically contemplated to lower the pH of the dispersing medium immediately before introduction of the divalent sulfur atom containing compound. This latter approach has the advantage of allowing divalent sulfur atom containing compounds that have limited solubility in the dispersing medium to be adsorbed to the grains in preference to precipitation within the dispersing medium. Thus, whether introduction of the divalent sulfur atom containing compound is optimally undertaken before or after the pH is lowered is a function of the particular compound being employed and particularly its solubility and rate of precipitation.

As previously indicated, the photographically useful compound is preferably introduced into the dispersing medium and the pH of the dispersing medium is reduced before emulsion washing, so that the released protonated 2-hydroqminoazine can be removed from the emulsion without undertaking a second washing step. The 2-hydroaminoazine can be released from the grain surfaces before or after chemical sensitization. The addition of a photographically useful compound, such as a spectral sensitizing dye or antifoggant, to an emulsion before chemical sensitization is a common practice and entirely compatible with the practice of this invention.

Apart from the features of the invention that have been specifically described, the emulsions and their preparation can take any convenient conventional form. Research Disclosure, Vol. 308, December 1989, Item 308119, is here incorporated by reference for its disclosure of conventional emulsion features, and attention is specifically directed to Sections IV, VI and XXI. Examples The invention can be better appreciated by reference to the following specific embodiments.

Control Example 1

Host Emulsion Preparation Using 4,5,6-Triaminopyrimidine as Growth Modifier.

A reaction vessel contained 4L of a solution at pH 6.0 and at 40° C. that was 2% in bone gelatin, 1.5 mM in 4,5,6-triaminopyrimidine, 0.040M in NaCl, and 0.20M in sodium acetate. To this stirred solution at 40° C. was added 4M silver nitrate solution and 4M NaCl solution. The silver nitrate solution was added at 2.5 mL/min for 1 min then its flow rate was accelerated to 47 mL/min during a period of 28 min. A total of 2.68 mole of silver nitrate was added. The 4M NaCl solution was added at a rate needed to maintain a constant pCl of 1.40. The pH was maintained at 6.0±0.1 during the precipitation. To the final emulsion was added 53 g of phthalated gelatin (U.S. Pat. No. 2,614,929) in 200 mL distilled water.

The resulting unwashed high aspect ratio AgCl tabular grain emulsion contained a tabular grain population that made up 80% of the total projected area of the grains. The tabular grain population had a mean equivalent circular diameter of 1.87 μm, a mean thickness of 0.083 μm (measuring $>1\times10^6$ grains), and an average aspect ratio of 22.6. A carbon replica electron photomicrograph is shown in FIG. 1.

Control Example 2

Low pH Washing of Control Example 1 Without Dye

An 0.05 mole portion of Control Example 1 emulsion was added to 700 mL distilled water. The pH of the mixture was lowered to 3.5 resulting in the desired coagulation of the emulsion. The mixture was allowed to stand for 2 hrs at 2° C., then the clear supernatant was discarded and the solid phase was resuspended to a total weight of 90 g with a solution consisting of 1% in gelatin and 4.1 mM in NaCl. The pH was adjusted to 5.5.

Figure 2:
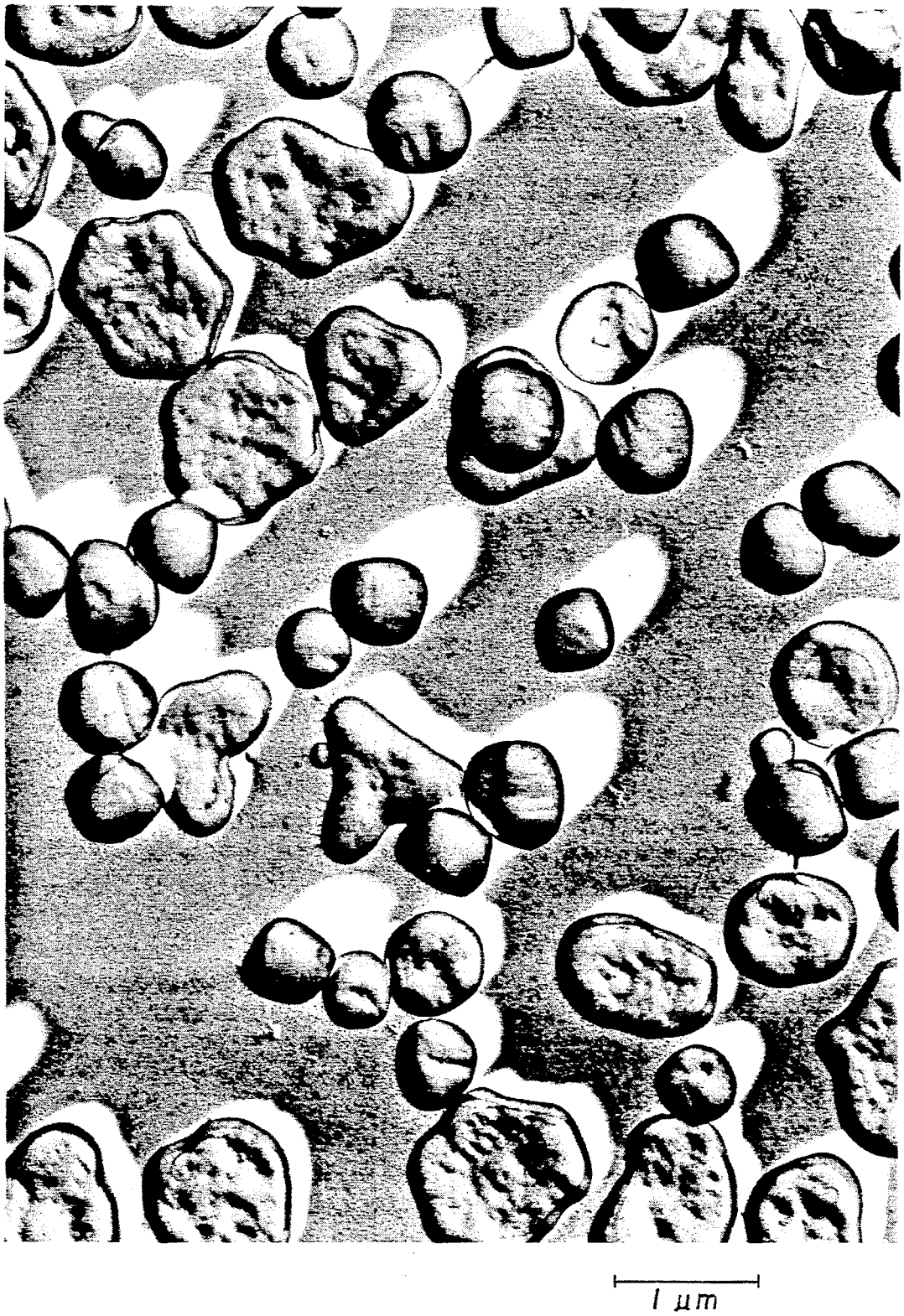

The resulting emulsion no longer consisted of high-aspect-ratio tabular grains. The grains were substantially ripened due to the protonation and desorption of the morphological stabilizer. A carbon replica electron photomicrograph is shown in FIG. 2.

Example 3

Low pH Washing of Control Example 1 Morphologically Stabilized With Spectral Sensitizing Dye A An 0.05 mole portion of Control Example 1 emulsion was treated similar to that of Control Example 2, except that 0.0885 mmole of anhydro-5-chloro-3,3'- di-(3-sulfopropyl)naphtho[1,2-d]triazolothiacyanine hydroxide, triethylamine salt, hereinafter referred to as Dye A, dissolved in 5 mL of methanol was added to the emulsion and it was stirred at 40° C. for 30 min before being added to 700 mL distilled water.

Figure 3:
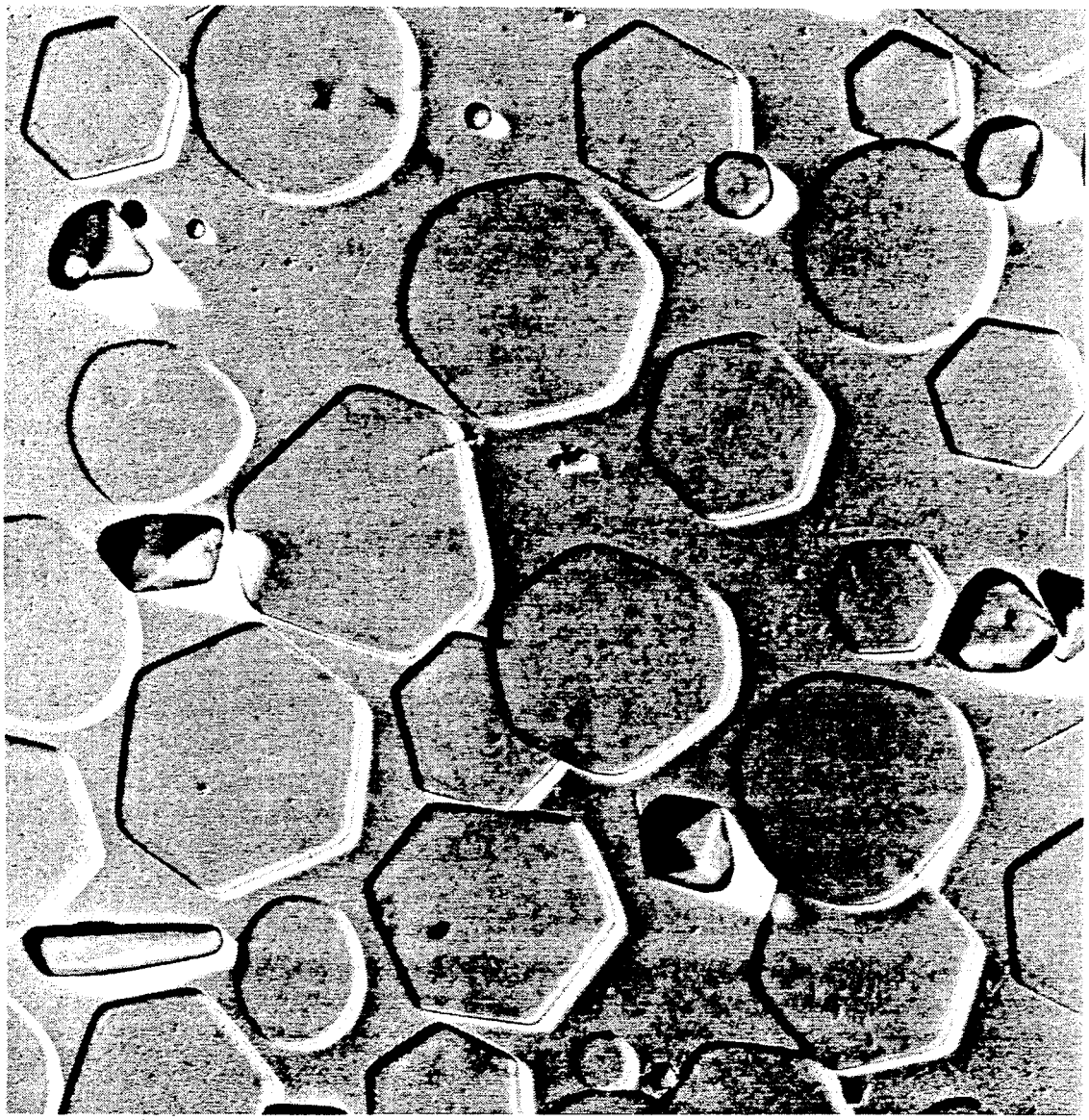

The resulting emulsion was still a tabular grain emulsion consisting of high-aspect-ratio tabular grains showing that the dye prevented substantial ripening of the tabular grains even though, from the results of Control Example 2, the morphological stabilizer was substantially protonated, desorbed, and discarded in the supernatant wash water. A carbon replica electron photomicrograph is shown in FIG. 3.

Example 4

Low pH Washing of Control Example 1 having 1 Mole % Added NaBr and Spectral Sensitizing Dye A An 0.05 mole portion of Control Example 1 emulsion was treated similar to that of Example 3, except that 1 min after Dye A, was added, 1 mL of 0.5M NaBr solution was added.

The resulting tabular grain emulsion consisted of high-aspect-ratio tabular grains showing that the dye with 1 mole % added bromide prevented substantial ripening of the tabular grains even though the 2-hydroxyaminoazine morphological stabilizer was substantially protonated and desorbed.

Example 5

Photographic Response

This example illustrates the chemical sensitization of emulsions which had been washed and stabilized with a dye containing at least one divalent sulfur atom.

Figure 4:
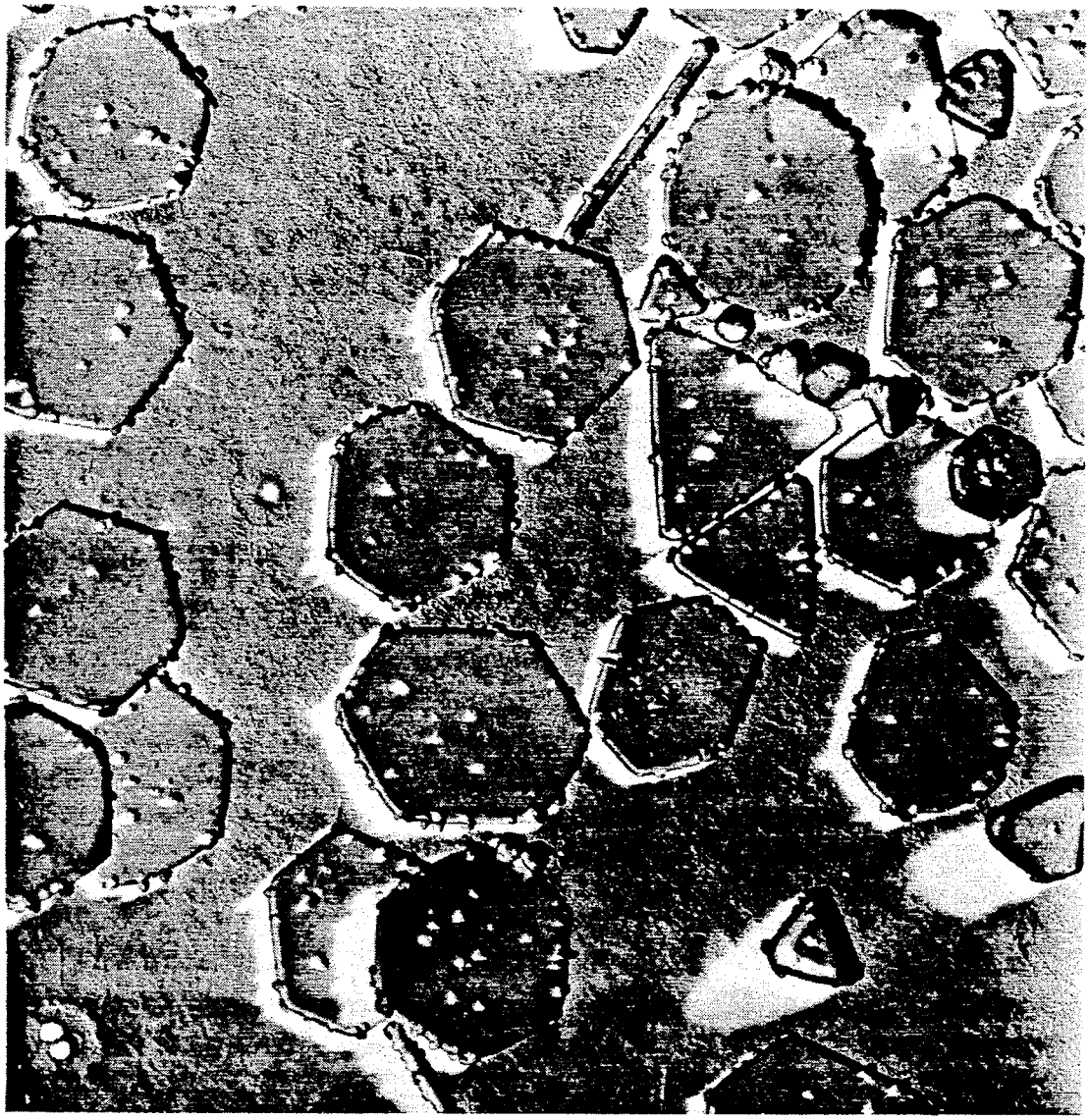

The washed and spectrally sensitized emulsions prepared in Examples 3 and 4 were chemically sensitized in the following manner. To portions of the emulsions were added $Na_2S_2O_3.5H_2O$ (5 mg/Ag mole) and $KAuCl_4$(5 mole) The emulsion of Example 3 had NaSCN (1.6 g/Ag mole) additionally added. The emulsions were heated at 65° C. for 5 min. Samples of these two chemically sensitized emulsions were examined by optical and electron microscopy. The emulsion grains retained their high aspect ratio. The chemically sensitized emulsion made from Example 4 is shown in FIG. 4. The epitaxial growths, primarily at the edges of the tabular grains, are believed to be AgBr.

The emulsions were coated on polyester film support at 1.3 g Ag/m$^2$ and 3.4 g gelatin/m$^2$. Coatings A and B were control coatings of the non-chemically sensitized emulsions of Example 3 and Example 4 respectively. Coatings C and D were coatings of the above chemically sensitized emulsions made from emulsions of Example 3 and Example 4 respectively. The coatings were exposed for 0.5 sec to a 600 W 3,000° K. tungsten light source through a 0–4.0 density step tablet. The exposed coatings were developed in Kodak Developer DK-50 TM at 20° C. Coatings A, B and D were developed for 5 min and coating C for 1 min. The photographic sensitivity of the resulting images were measured at a density of 0.2 above Dmin. They show that the two chemically sensitized coatings have a higher photographic sensitivity than their respective nonsensitized controls.

TABLE I

| Coating | Chemically sensitized | Dmin | Dmax | Relative speed |
|---|---|---|---|---|
| A | No | 0.09 | 1.03 | 100 |
| C | Yes | 0.37 | 1.52 | 490 |
| B | No | 0.06 | 1.38 | 100 |
| D | Yes | 0.14 | 1.62 | 759 |

The spectral response of Coatings A and B were also measured. The coatings were exposed for 1 sec to a variable wavelength (x-axis), variable intensity (y-axis) wedge spectrograph. They were then processed using Kodak Developer DK-50 TM for 5 min at 20° C. The resulting image from Coating A had a Dmin of 0.07 and a Dmax of 1.09. The resulting image from Coating B had a Dmin of 0.05 and a Dmax of 1.34. Both images showed a peak spectral response at ~480 nm showing that Dye A had adsorbed as its J-aggregate. (The absorption maximum of the dye dissolved in methanol is 445 nm.)

Example 6

Photographic Response of Emulsion Chemically Sensitized Before Washing

This example illustrates that a high chloride tabular grain emulsion can be first chemically sensitized in the presence of the grain morphological stabilizer used to make the emulsion and then the modifier replaced by a dye which both serves as morphological grain stabilizer and a spectral sensitizer.

Figure 5:
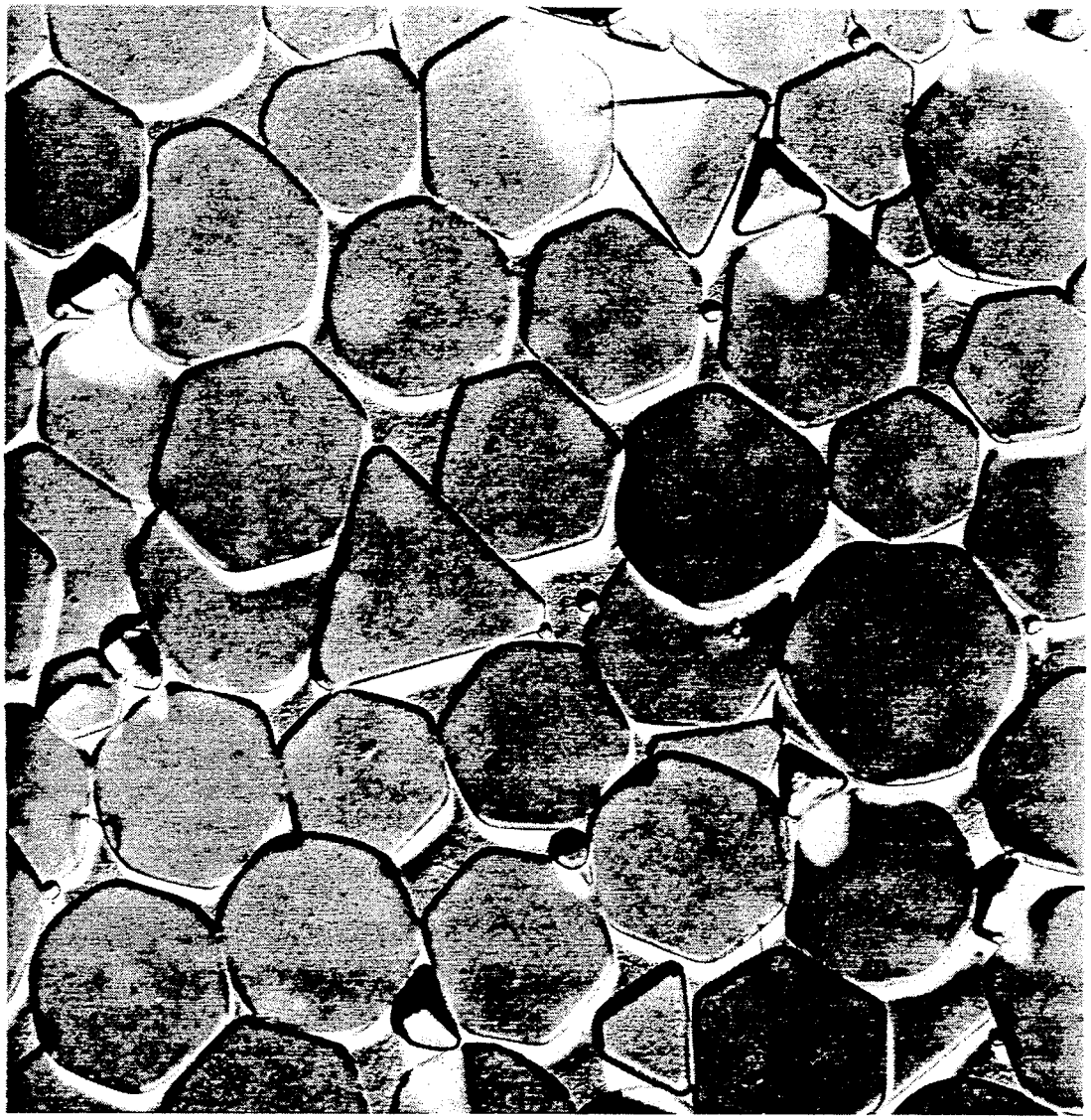

A portion of the unwashed host emulsion of Control Example 1 was heated for 5 min at 65° C. with $Na_2S_2O_3.5H_2O$ (5 mg/Ag mole) and $KAuCl_4$ (5 mg/Ag mole). The emulsion was cooled to 40° C., then 1 mole% NaBr and 1.42 mmole of Dye A per mole AgCl were added. The emulsion was stirred for 15 min at 40° C. and then poured into 12 times its volume of distilled water. The pH of the mixture was lowered to 3.5 resulting in the desired coagulation of the emulsion. The mixture was allowed to stand for 2 hrs at 2° C. The solid phase was resuspended in a solution consisting of 1% in gelatin and 4.1 mM in NaCl and then the pH was adjusted to 5.5. The final emulsion, FIG. 5, was similar to the starting Control Example 1 emulsion in that it was a high aspect ratio tabular grain emulsion. The resulting emulsion was coated on polyester film support at 1.3 g $Ag/m^2$ and 3.4 g $gelatin/m^2$.

A nonchemically sensitized emulsion control coating was prepared by using the above procedure, but without adding the $Na_2S_2O_3.5H_2O$ and $KAuCl_4$. The absorptance of portions of the coatings were measured to determine if the dye had formed a J-aggregate. The coatings of the sensitized and nonsensitized emulsions were exposed for 0.5 sec to a 600 W, 3,000° K tungsten light source through a 0.40 density step tablet. The exposed coatings were developed in Kodak Developer DK-50 TM at 20° C. Sensitized emulsion coatings were developed for 0.5 and 1.0 min. The photographic speed was determined at an optical density of 0.20 above the Dmin density. The results are summarized in Table II.

TABLE II

| Coating | Absorptance maximum (nm) | Dev. time (min) | Dmin | Dmax | Relative speed |
|---|---|---|---|---|---|
| Nonsensitized | 478 | 1.0 | 0.04 | 1.39 | 100 |
| Sensitized | 478 | 0.5 | 0.28 | 1.34 | 760 |
| Sensitized | 478 | 1.0 | 0.52 | 1.38 | 1580 |

Example 7

Concentration Series for Two Divalent Sulfur Containing Morphological Stabilizers.

These examples show that morphological stabilization does not require a full monolayer coverage of the adsorbed divalent sulfur atom containing compound, but that significantly less is sufficient. It is believed that at these lower levels, the stabilizer inhibits growth near the reactive grains edges and that this prevents grain ripening into non-tabular forms. (It is believed that a principal mechanism for tabular grain ripening to non-tabular forms is dissolution of the central region of the two major {111} faces and deposition of this material at the more reactive grains edges.)

Example 7

A Dye A Stabilizer

To 0.025 mole portions of the Control Example 1 emulsion (calculated surface area of 725 $m^2$/mole Ag) were added various amounts of a solution of Dye A. Each sample was stirred for 30 min at 40° C. and then added to 700 mL of distilled water. The pH of the mixture was lowered to 3.5, resulting in coagulation of the emulsion. The sample was allowed to stand for 2 hrs at 2° C., then the clear supernatant was discarded and the solid phase was resuspended to a total weight of 45 g with a solution consisting of 1% in gelatin and 4.1 mM in NaCl. The pH was adjusted to 5.5. After examination by optical and electron microscopy, Samples 3 and 4 were lowered to pH 2.0 and stirred for 150 min. at 40° C. and examined again. This second pH drop to a higher acidity had no significant effect on the tabularity of the emulsions. The results are given in Table III.

Example 7B

1-(3-acetamidophenyl)-5-mercaptotetrazole Stabilizer

Samples were prepared similar to those of Example 7A except that instead of adding Dye A, appropriate amounts of an aqueous solution of 1-(3-acetamidophenyl)-5-mercaptotetrazole sodium salt, (APMT), a conventional antifoggant, were added. Samples 7 and 8 were lowered to pH 2.0 and stirred for 150 min at 40° C. The grains showed no further change. The results are given in Table III.

TABLE III

| Sample | Stabilizer | Amount of stabilizer added (mmole/mole Ag) | Calculated % of monolayer coverage | Tabular grain emulsion after washing? |
|---|---|---|---|---|
| 1 | — | 0.00 | 0.0 | No |
| 2 | Dye A | 0.20 | 12.5 | No |
| 3 | Dye A | 0.40 | 25 | Yes |
| 4 | Dye A | 0.81 | 50 | Yes |
| 5 | Dye A | 1.21 | 75 | Yes |
| 6 | APMT | 0.65 | 12.5 | No |
| 7 | APMT | 1.31 | 25 | Yes |

TABLE III-continued

| Sample | Stabilizer | Amount of stabilizer added (mmole/mole Ag) | Calculated % of monolayer coverage | Tabular grain emulsion after washing? |
|---|---|---|---|---|
| 8 | APMT | 2.62 | 50 | Yes |
| 9 | APMT | 3.92 | 75 | Yes |
| 10 | APMT | 5.23 | 100 | Yes |

Example 8

Proportion of Grain Morphological Stabilizer Removed at Low pH

Portions of Control Example 1 emulsion had stabilizer added, pH adjusted and were stirred at 40° C. as summarized in Table IV. After treatment, each portion was examined by optical microscopy to determine if it was still a high aspect ratio tabular grain emulsion. The resulting emulsion was centrifuged and the clear supernatant was analyzed for 4,5,6-triaminopyrimidine by HPLC (high performance liquid chromatography). (For Portions 6,7,and 8, no APMT was detected in the supernatants indicating that it had been strongly adsorbed.) The results are given in Table IV. Note that Portion 2 was at pH 3.5 without added stabilizer and that the tabular grains ripened away resulting in a non-tabular grain emulsion. The portions with added stabilizer and at low pH retained the high-aspect-ratio tabular grains. Portion 6 had ~50% of grain monolayer coverage of APMT added which displaced 53.6% of the adsorbed grain morphological stabilizer at pH 6.1 (63.0% found in supernatant minus 9.4% found not adsorbed to the grains in Portion 1 equals 53.6% displaced). Lowering the pH to 3.5 or to 2.0 causes more grain morphological stabilizer to be removed from the grains while maintaining a high-aspect-ratio (>8.1) tabular grain emulsion.

TABLE IV

| Portion | Stabilizer | Amount (mmole/mole Ag) | pH | Resulting emulsion tabular? | TAP[a] in supernatant (% of total possible) |
|---|---|---|---|---|---|
| 1 | None | — | 6.1 | Yes | 9.4 |
| 2 | None | — | 3.5 | No | 84.7 |
| 3 | Dye A | 0.40[b] | 6.1 | Yes | 3.4 |
| 4 | " | " | 3.5 | Yes | 78.3 |
| 6 | APMT[a] | 2.61[c] | 6.1 | Yes | 63.0 |
| 7 | " | " | 3.5 | Yes | 83.4 |
| 8 | " | " | 2.0 | Yes | 85.5 |
| Control | — | — | — | — | 91.7d |

[a]TAP is 4,5,6-triaminopyrimidine; APMT is 1-(3-acetamidophenyl)-5-mercaptotetrazole sodium salt.
[b]Estimated 25% of grain monolayer coverage.
[c]Estimated 50% of grain monolayer coverage.
[d]Only 91.7% of the amount of TAP in this control was detected. The control consisted of a solution of 0.74% gel, 0.5M $NaNO_3$, 0.15M NaOAc and 0.977 mM TAP adjusted to pH 3.5.

Example 9

Spectral Sensitization of AgCl Tabular Grain Emulsion that was Stabilized and Washed.

Example 9A

Preparation of Stabilized and Washed Emulsion.

To a 0.10 mole portion of the Control Example 1 emulsion was added 2.0 mL of a 0.065 M solution of 1-(3-acetamidophenyl)-5-mercaptotetrazole, sodium salt to give a calculated coverage of 25% of the grains' surface area. The emulsion was stirred for 30 min at 40° C. at pH 6.0 and then added to 3L of distilled water. The mixture was adjusted to pH 3.5, and after standing for 2 hrs at 2 ° C., the clear supernatant was discarded and the solid phase was resuspended in a solution consisting of 1% in gelatin and 4.1 mM in NaCl. The pH was adjusted to 5.5. The final emulsion was a high aspect ratio tabular grain emulsion as revealed by optical microscopy.

Example 9B

Spectrally Sensitized Emulsion

To a 0.025 mole portion of the washed and stabilized Emulsion 9A was added a methanol solution of Dye A (0.81 mmole dye per mole AgCl) and the mixture was stirred for 30 min at 40 ° C. The spectrally sensitized emulsion was coated on polyester film support at 1.3 g Ag/$m^2$ and 3.4 g gelatin/$m^2$. The coating was exposed for 4 sec to a variable wavelength (x-axis), variable intensity (y-axis) wedge spectrograph. They were then processed using Kodak Developer DK-50 TM for 5 min at 20° C.

The resulting image had a peak spectral response at 475 nm. The peak absorptance of the unprocessed coating was at 474 nm and was 32% of the maximum absorptance possible.

A coating prepared similarly but using spectrally sensitized unwashed Control Example 1 emulsion had a similar absorptance peak but the peak height was only 23% of the maximum absorptance possible. This shows that less dye is adsorbed in the presence of adsorbed morphological stabilizer.

Example 9C

Spectrally Sensitized Emulsion

To a 0.025 mole portion of the washed and stabilized Emulsion 9A was added 0.5 mL of a 0.5M NaBr solution and a methanol solution of anhydro-5-chloro-9-ethyl-5'-phenyl-3-(3-sulfopropyl)-3'-(3-sulfobutyl)oxacarbocyanine hydroxide (0.81 mmole dye per mole AgCl). The resulting mixture was stirred for 30 min at 40° C. This emulsion was coated, exposed and processed similar to Emulsion 9B.

The resulting image had a peak spectral response at 530 nm. This demonstrated that ability of the dye to spectrally sensitize the emulsion despite the prior adsorption of a morphologically stabilizing amount of APMT to the grain surfaces.

Example 10

Color Photographic Paper Made from High Chloride Tabular Grain Emulsion

To a 0.025 mole portion of Control Example 1 emulsion were added a methanol solution of 0.20 mmole/mole Ag of Dye A and an aqueous solution of 1.31 mmole/mole Ag of APMT. The mixture was stirred for 30 min at 40° C., then added to 700 mL distilled water. The pH was lowered to 3.5 and the mixture was allowed to stand for 18 hrs at 2° C. The solid phase was resuspended to a total weight of 45 g with a solution consisting of 1% in gelatin and 4.1 mM in NaCl. The pH was adjusted to 5.5.

The emulsion was divided into two portions (Portions A and B). To Portion B were added 5 mg/mole Ag of $Na_2S_2O_3.5H_2O$ and 5 mg/mole Ag of $KAuCl_4$. Both emulsions were heated at 65° C. for 5 min. Samples of these two emulsions were examined by optical microscopy. They were high-aspect-ratio tabular grain emulsions.

The emulsions were mixed with a yellow coupler dispersion, gelatin, surfactant, and hardener and hand coated on paper support at 0.33 g Ag/m$^2$, 1.3 g coupler/m$^2$ and 3.7 g gelatin/m$^2$. The coatings were exposed for 0.5 sec to a 600W 3,000° K tungsten light source through a 0.40 density step-tablet. The exposed coatings were developed in Kodak RA4 TM color developer for 20 min at 35° C. Both coatings had a yellow dye image. The processed coating made from Portion A had a maximum yellow density of 2.22, minimum yellow density of 0.10 and a relative speed of 100. The processed coating made from Portion B had a maximum yellow density of 2.03, a minimum yellow density of 0.95 and a relative speed of 1479. The spectral response of the emulsions coated on clear polyester support was also measured The coatings were exposed on a wedge spectrograph and processed using Kodak developer DK-50 TM. The coatings of the two emulsions had a peak spectral response at 470 (±5) nm.

Control Example 11

Host Emulsion Preparation Using 7-Azaindole as Morphological Stabilizer.

To a stirred reaction vessel containing 400 mL of a solution at pH 6.0 and at 40 ° C. that was 2% in bone gelatin, 0.040M in NaCl, and 0.20M in sodium acetate was added 0.60 mmole of 7-azaindole dissolved in 2 mL of methanol. Then a 4M silver nitrate solution and a 4M NaCl solution were added. The silver nitrate solution was added at 2.5 mL/min for 4 min Then its flow rate was stopped and 0.60 mmole of 7-azaindole in 2 mL of methanol was added. The silver nitrate solution flow was resumed at 0.25 mL/min for 1 min. Then the flow rate was accelerated over an additional period of 30 min (20X from start to finish) and finally held constant at 5 mL/min until 0.4 mole of silver nitrate was added.

The NaCl solution was added at a similar rate as needed to maintain a constant pAg of 7.67. When the pH dropped 0.1 unit below 6.0, the pH was adjusted back to the starting value. Additional 0.60 mmole portions of 7-azaindole dissolved in methanol were added when 0.13 and 0.27 mole of silver nitrate had been added.

The resulting tabular grain emulsion contained 75%, by projected area, of a tabular grain population which had a mean diameter of 1.22 μm, a mean thickness of 0.083 μm and a mean aspect ratio of 14.7.

Control Example 12

Low pH Washing of Emulsion Without Added Morphological Stabilizer

An 0.025 mole portion of Control Example 11 emulsion was added to 350 mL of a solution containing 0.5 g of phthalated gelatin. The pH of the mixture was lowered to 3.5 resulting in the desired coagulation of the emulsion. The mixture was allowed to stand for 2 hrs at 2° C, then the solid phase was resuspended to a total weight of 45 g with a solution consisting of 1% in gelatin and 4.1 mM in NaCl. The pH was adjusted to 5.5.

Figure 6:
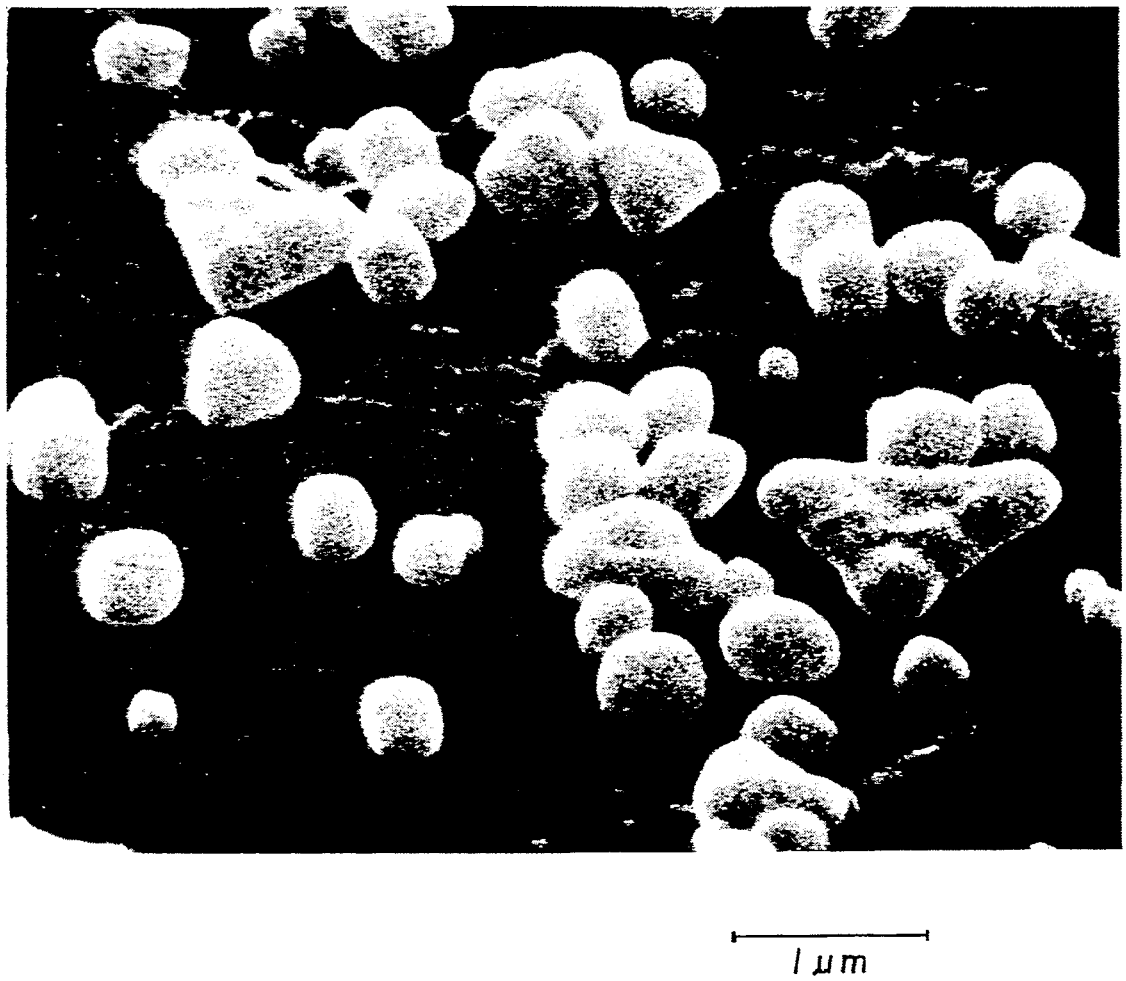
FIGS. 6 to 8 inclusive are scanning electron photomicrographs.

The resulting emulsion was not a tabular-grain emulsion. The tabular grains had ripened due to the loss of morphological stabilizer. A scanning electron photomicrograph is shown in FIG. 6.

Example 13

Low pH Washing of Control Example 11 Morphologically Stabilized With Spectral Sensitizing Dye A An 0.025 mole portion of Control Example 11 emulsion was treated similar to that of Control Example 12 except that prior to adding it to the solution of phthalated gelatin, the emulsion was stirred with 1.42 mmole of Dye A per Ag mole for 30 min at 40° C.

Figure 7:
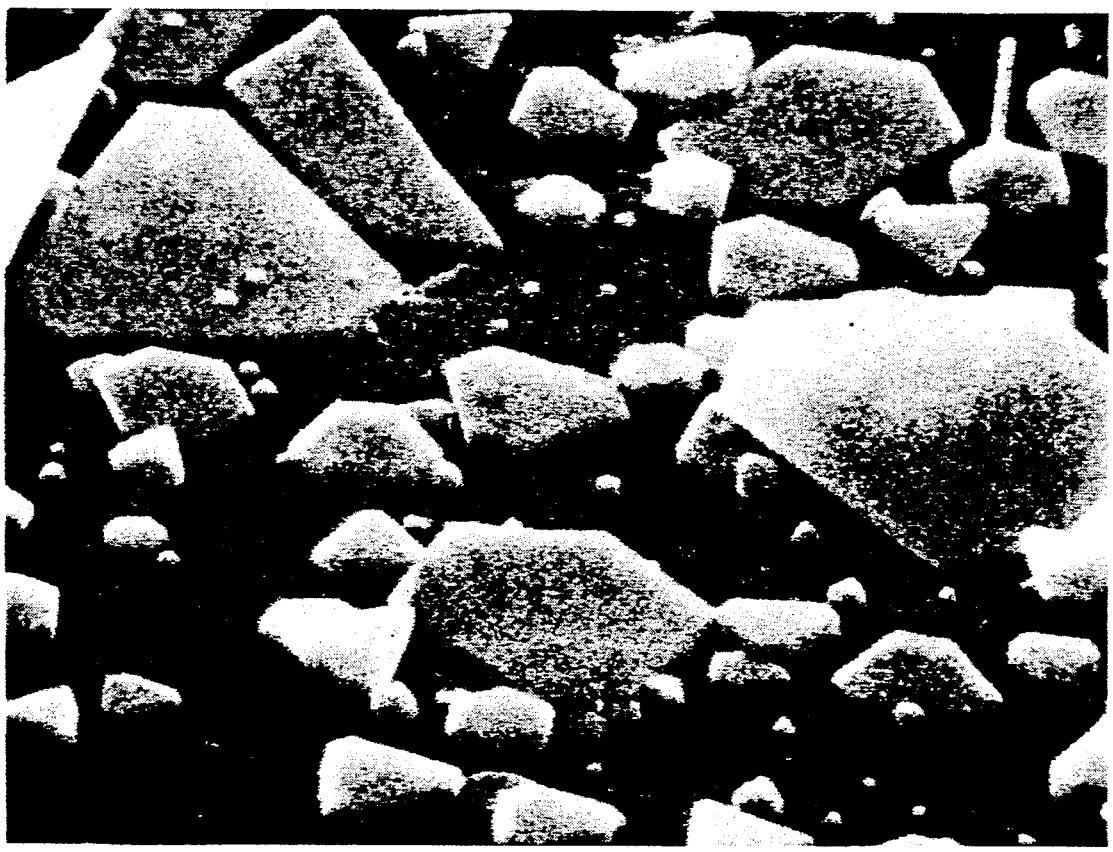

The resulting emulsion was a tabular grain emulsion similar in mean size and mean thickness to the starting host emulsion. The emulsion is shown in FIG. 7. A coating of this emulsion had an absorptance maximum at 476 nm consistent with a J-aggregate.

Example 14

Low pH Washing of Control Example 11 having 1Mole % Added NaBr and Morphologically Stabilized with Spectral Sensitizing Dye A An 0.025 mole portion of Control Example 11 emulsion was treated similar to that of Example 13 except that 0.5 mL of a 0.5M NaBr solution was added just prior to the dye solution.

The resulting emulsion was a tabular grain emulsion similar in mean size and mean thickness to the starting host emulsion. A coating of this emulsion had an absorptance maximum at 475 nm.

Example 15

Low pH Washing of Control Example 11 Morphologically Stabilized with a Merocyanine Dye A portion of Control Example 11 emulsion was treated similar to that of Example 13, except that 1.42 mmole of 3-(carboxymethyl)-5-[(3-ethyl-2-thiazolidinylidene)ethylene]rhodanine per Ag mole was used instead of Dye A.

The resulting tabular grain emulsion was similar to the starting host tabular grain emulsion in that there were no indications of ripening of the tabular grain population. A coating of this emulsion had an absorptance maximum at 530 nm, indicating that a J-aggregate was formed. (The Dmax of the dye dissolved in MeOH is 478 nm.)

Control Example 16

AgClBr Shell on Control Example 11 Host Emulsion Following U.S. Pat. No. 5,035,992

A 0.30 mole portion of Control Example 11 emulsion was placed in a stirred reaction vessel. Two mL of a 4M NaBr solution was pumped at a rate of 1.0 mL/min into 8 mL of a 4M NaCl solution with stirring and simultaneously this chloride solution was pumped continuously into the reaction vessel at 5 mL/min. The precipitation was stopped when these two halide solutions had been delivered to the reaction vessel. The resulting high chloride silver halide emulsion had an overall composition of 2.35 mole % bromide. The mean tabular grain thickness was greater than that of the host, 0.086 μm vs 0.083 μm.

Control Example 16

A Low pH Washing of Control Example 16 Without Added Morphological Stabilizer

An 0.05 mole portion of Control Example 16 emulsion was added to 700 mL distilled water. The pH of the mixture was lowered to 3.5 resulting in the desired coagulation of the emulsion. The mixture was allowed to stand for 2 hrs at 2° C., then the clear supernatant was discarded and the solid phase was resuspended to a total weight of 90 g with a solution consisting of 1% in gelatin and 4.1 mM in NaCl. The pH was adjusted to 5.5.

Figure 8:
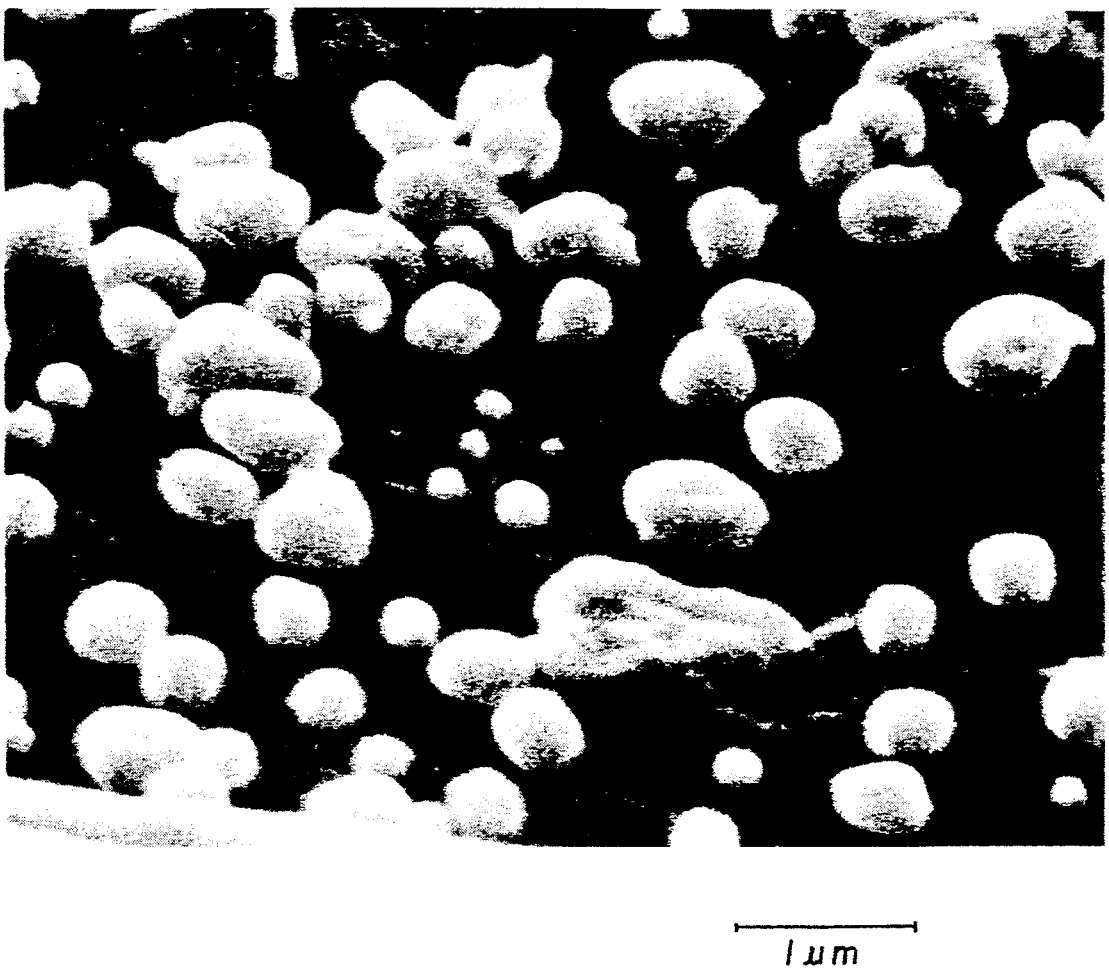

The resulting emulsion no longer contained high aspect ratio tabular grains. This result showed that the bromide shell was insufficient to protect the grains from ripening in the absence of a morphological stabilizer. A representative view is shown in FIG. 8.

Example 17

Ultrathin AgCl High Aspect Ratio Tabular Grain Emulsion

A stirred reaction vessel containing 400 mL of a solution which was 2% in bone gelatin, 1.8 mM in 4,5,6-triaminopyrimidine, 0.040M in NaCl, and 0.20M in sodium acetate was adjusted to pH 6.0 with $HNO_3$ at 40° C. To this solution at 40° C. were added a 4M $AgNO_3$ solution at 0.25 mL/min and a salt solution at a rate needed to maintain a constant pAg of 7.67 (0.04M in chloride). The salt solution was 4M in NaCl and 15.9 mM in 4,5,6-triaminopyrimidine and was adjusted to a pH of 6.33 at 25° C. After 4 min of addition, the additions were stopped and the pH of the reaction vessel was adjusted to 5.1 with $HNO_3$ requiring 45 sec. The flow of the $AgNO_3$ solution was resumed at 5 mL/min until 0.13 mole of Ag had been added. The flow of the salt solution was also resumed at a rate needed to maintain a constant pAg of 7.67. When the pH dropped below 5.0, the pH was adjusted back to 5.1.

The resulting emulsion contained ultrathin tabular silver chloride grains accounting for greater than 75 percent of total grain projected area. The tabular grains had a mean effective circular diameter of 0.74 μm, a mean thickness of 0.043 μm and an average aspect ratio of 17.2.

Example 18

AgBrCl (10 Mole % Br) Ultrathin High Aspect Ratio Tabular Grain Emulsion

A stirred reaction vessel containing 400 mL of a solution which was 2% in bone gelatin, 3.6 mM in adenine, 0.030M in NaCl, and 0.20M in sodium acetate was adjusted to pH 6.2 with $HNO_3$ at 75° C. To this solution at 75° C. was added 4M silver nitrate solution at 0.25 mL/min for 1 min and then the rate of solution was linearly accelerated over an additional period of 30 min (20X from start to finish) and finally held constant at 5.0 mL/min until 0.27 mole of silver nitrate was consumed. When the pH reached 6.0, the emulsion was adjusted back to pH 6.2 with NaOH. The pAg was held constant at 6.64 (0.04M in chloride) by adding a solution that was 3.6M in NaCl, 0.4M in NaBr and 16 mM in adenine and had a pH of 6.3.

The resulting emulsion contained ultrathin tabular silver bromochloride grains accounting for greater than 70 percent of total grain projected area. The tabular grains had a mean effective circular diameter of 0.87 μm, a mean thickness of 0.028 μm and an average aspect ratio of 31.0.

The invention has been described in detail with particular reference to preferred embodiments thereof, but it will be understood that variations and modifications can be effected within the spirit and scope of the invention.

What is claimed is:

1. A process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one 2-hydroaminoazine adsorbed to and morphologically stabilizing the tabular grains, and (2) adsorbing to surfaces of the tabular grains a photographically useful compound,

CHARACTERIZED IN THAT (a) 2-hydroaminoazine adsorbed to the tabular grain surfaces is protonated and thereby released from the tabular grain surfaces into the dispersing medium, (b) the released 2-hydroaminoazine is replaced on the tabular, grain surfaces by adsorption of the photographically useful compound, the photographically useful compound being selected from among those containing at least one divalent sulfur atom, thereby concurrently morphologically stabilizing the tabular grains and enhancing their photographic utility, and (c) released 2-hydroaminoazine is removed from the dispersing medium.

2. A process according to claim 1 further characterized in that the tabular grains are chemically sensitized prior to releasing the 2-hydroaminoazine from their surfaces.

3. A process according to claim 1 further characterized in that the photographically useful compound is present in the emulsion prior to releasing the protonated 2-hydroaminoazine.

4. A process according to claim 3 further characterized in that the emulsion is chemically sensitized after the protonated 2-hydroaminoazine is released from grain surfaces.

5. A process according to claim 1 further characterized in that the photographically useful compound is a spectral sensitizing dye.

6. A process according to claim 5 further characterized in that the spectral sensitizing dye contains a thiazoline, thiophene, thiazole, rhodanine or isorhodanine ring.

7. A process according to claim 6 further characterized in that the spectral sensitizing dye includes a benzothiazole, napthothiazole, phenanthrothiazole or acenapthothiazole nucleus.

8. A process according to claim 1 further characterized in that the photographically useful compound is an antifoggant or stabilizer.

9. A process according to claim 1 further characterized in that the photographically useful compound includes a mercapto, alkylthia or arylthia moiety.

10. A process according to claim 1 further characterized in that the 2-hydroaminoazine is selected from the group consisting of (A)

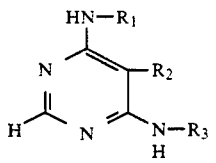

wherein $R_1$, $R_2$ and $R_3$ are, independently, H or alkyl of 1 to 5 carbon atoms; $R_2$ and $R_3$ when taken together are $—CR_4{=}CR_5—$ or $—CH_4{=}N—$, wherein $R_4$ and $R_5$ are, independently, H or akyl of 1 to 5 carbon atoms, with the proviso that when $R_2$ and $R_3$ taken together form the $—CR_4{=}N—$ linkage, $—CR_4{=}$ must be joined to the ring at the $R_2$ bonding position;

(B)

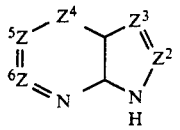

where $Z^2$ is $—C(R^2){=}$ or $—N{=}$;

$Z^3$ is $—C(R^3){=}$ or $—N{=}$;

$Z^4$ is $—C(R^4){=}$ or $—N{=}$;

$Z^5$ is $—C(R^5){=}$ or $—N{=}$;

$Z^6$ is $—C(R^6){=}$ or $—N{=}$;

with the proviso that no more than one of $Z^4$, $Z^5$ and $Z^6$ is $—N{=}$;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$;

(C)

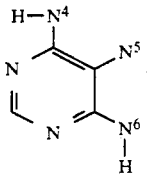

where $N^4$, $N^5$ and $N^6$ are independent amino moieties; and (D)

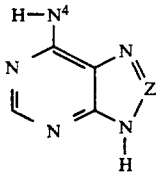

where $N^4$ is an amino moiety and

Z represents the atoms completing a 5 or 6 member ring.

11. A process according to claim 1 further characterized in that the 2-hydroaminoazine satisfies the formula:

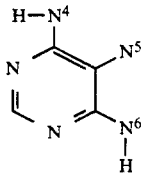

where $N^4$, $N^5$ and $N^6$ are independent amino moieties.

* * * * *